United States Patent [19]

Arnold

[11] Patent Number: 4,531,883

[45] Date of Patent: Jul. 30, 1985

[54] BACKHOE STABILIZER SYSTEM

[75] Inventor: Carroll H. Arnold, Westminster, Mass.

[73] Assignee: Wain-Roy, Inc., Hubbardston, Mass.

[21] Appl. No.: 448,023

[22] Filed: Dec. 8, 1982

[51] Int. Cl.[3] ..... E02F 3/00

[52] U.S. Cl. ..... 414/722; 37/DIG. 3; 37/DIG. 12; 212/189; 280/763.1; 414/912

[58] Field of Search ..... 414/719, 723, 724, 694, 414/722, 912; 37/73, 117.5, DIG. 12, DIG. 3; 280/703.1; 212/189

[56] References Cited

U.S. PATENT DOCUMENTS

| | | | |
|---|---|---|---|
| 2,745,328 | 5/1956 | Brimhall | 37/DIG. 3 |
| 3,403,940 | 10/1968 | Clark | 414/724 X |
| 3,913,942 | 10/1975 | MacKenzie | 212/189 X |
| 3,989,149 | 11/1976 | Smith et al. | 212/189 X |
| 4,026,428 | 5/1977 | Shumaker | 212/189 X |
| 4,216,974 | 8/1980 | Kassai | 280/650 X |
| 4,337,015 | 6/1982 | Friesen et al. | 212/189 X |
| 4,347,031 | 8/1982 | Friesen et al. | 212/189 X |

*Primary Examiner*—Robert J. Spar
*Assistant Examiner*—Donald W. Underwood

[57] ABSTRACT

A stabilization system to prevent movement of tractor equipment in response to digging action of a digging bucket disposed from one end of the tractor, in which the system has a friction surface and a bracket adapted to attach the friction surface to a loader-bucket/arm unit disposed from the end of the tractor opposite the digging bucket, and the bracket includes means for disposing the surface in a horizontal, downward attitude below the loader-bucket/arm unit, to support the tractor equipment.

12 Claims, 15 Drawing Figures

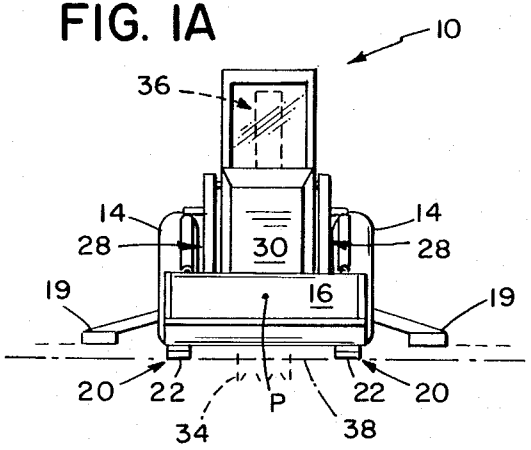
FIG. IA
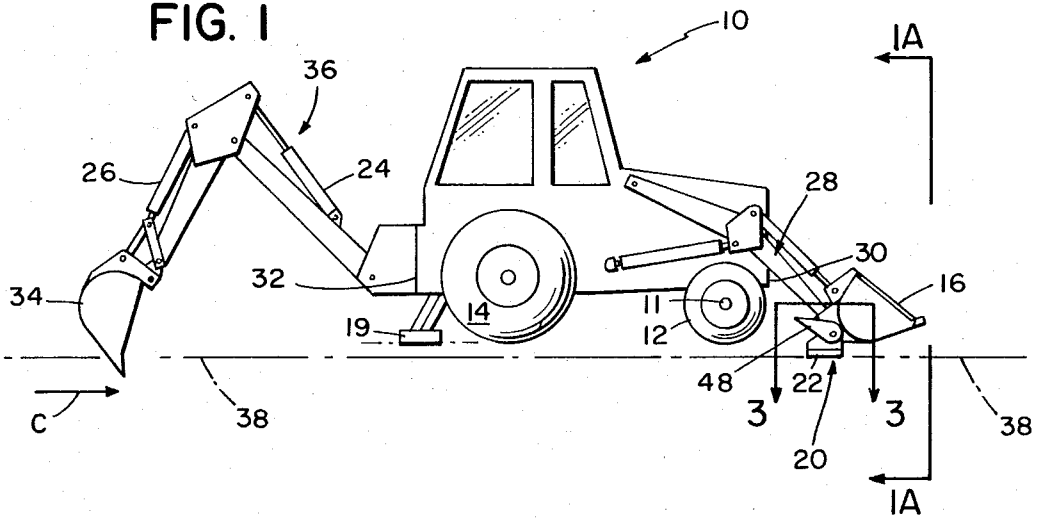
FIG. I
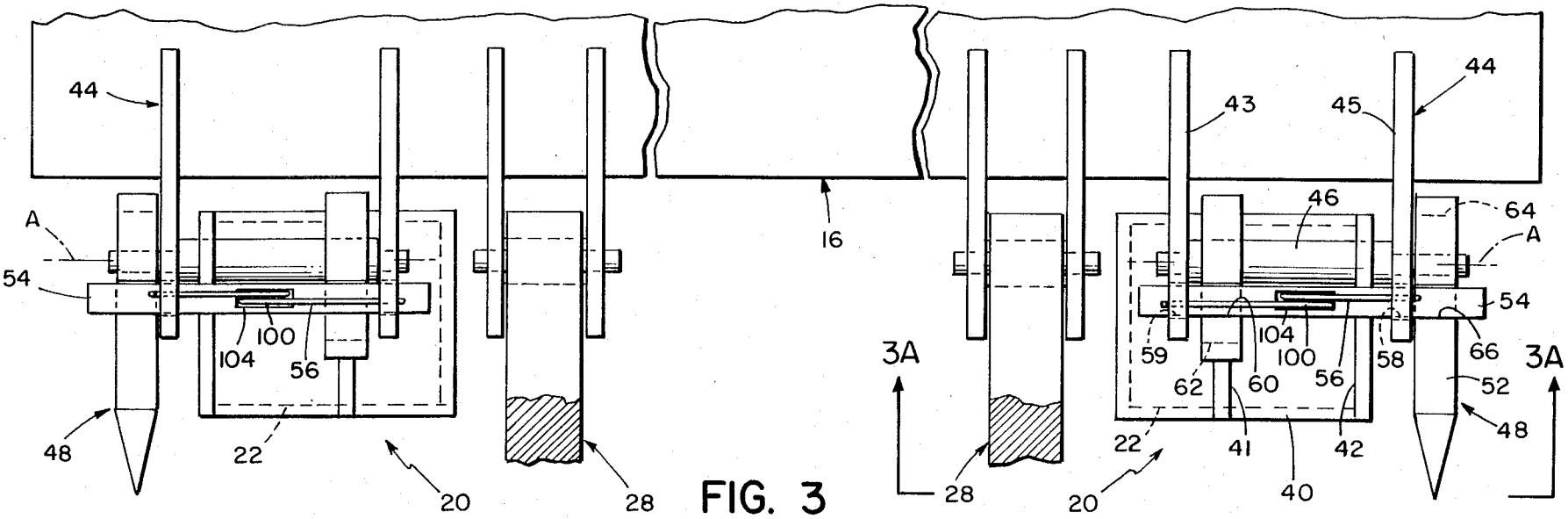
FIG. 3

BACKHOE STABILIZER SYSTEM

BACKGROUND OF THE INVENTION

This invention relates to systems for stabilizing tractor digging equipment such as those with backhoe/-loaders. Digging action imposes a translation force on the equipment, and some stabilization is necessary to prevent the equipment from tipping or rolling in response to that force.

In a conventional stabilization practice for backhoe/-loaders, the leading edge of the loader bucket is used to support the front end of the equipment as it is lifted from the ground by forward digging action by the backhoe at the other end. To achieve this position, the loader bucket must be placed in an orientation that is not recommended by the manufacturer, i.e., the bucket is fully rolled-over to orient the leading bucket edge in a downward position. Moreover, the degree of stabilization afforded by such a configuration depends in large part on the supporting substrate; while the leading bucket edge can dig effectively into soft materials such as loose dirt, it cannot dig into hard materials such as frozen ground or concrete surfaces, and for such hard surfaces, the loading bucket edge is not an effective stabilizer. Finally, the bucket edge may damage asphalt or other street surfaces.

It is an object of this invention to provide a stabilizer system readily installed as a retrofit to existing tractors which does not damage street surfaces, which does not impose undue stresses on the loader arm, linkage or pin, which is self-storing without loose pins or retainers in a configuration that does not interfere with normal loading operation, and which may be used on hard or frozen surfaces as well as soft surfaces.

SUMMARY OF THE INVENTION

In one aspect, the invention features a stabilization system to prevent movement of tractor equipment in response to digging action of a digging bucket disposed from one end of the tractor, in which the system has a friction surface and a bracket adapted to attach the friction surface to a loader-bucket/arm unit disposed from the end of the tractor opposite the digging bucket, and the bracket includes means for disposing the surface in a horizontal, downward attitude below the loader-bucket/arm unit, to support the tractor equipment.

In another aspect the system includes a vertically disposed stabilizer spike in place of the friction pad.

In still another aspect, the system is attached to the tractor digging equipment so that the friction surface contacts a ground-support area ahead of the tractor's front axle.

In the preferred embodiments, the friction surface is a soft durable material and the system includes a vertical spike; the attachment bracket includes a plate parallel to a second plate which is attached to the friction surface, and both the spike and second plate are attached to a hinge pin perpendicular to and attached to the bracket plate, so that the spike and surface may rotate independently about a horizontal axis generaly parallel to the front end of the tractor; the friction surface may be locked in its horizontal downward attitude or in a second attitude representing rotation at least 90° about the above-mentioned axis, and locking is achieved using notches in the second plate adapted to receive a spring biased member when the friction surface is in the desired attitude; alternatively, the friction surface and ike are connected in a unit and are disposed in oppo-
e directions; the surface/spike unit is attached to the
acket either by a mounting plate on the unit whose
posite edges are received by slots on parallel bracket
ates, or by a lock pin running through holes in a shaft
the unit and through corresponding holes in bracket
ates; and at least two stabilizer systems are attached to
ractor and the friction surfaces of those systems have
eir respective ground contact areas on opposite sides
the mid-point of the front end of the tractor cab.

DESCRIPTION OF THE PREFERRED EMBODIMENT

I turn now to a description of the preferred embodi-
ent of the invention, first briefly describing the draw-
gs thereof.

FIG. 1 shows loader/backhoe equipment with a sta-
izer system according to the present invention.

FIG. 1A is taken along 1A—1A of FIG. 1.

FIG. 3 is taken along 3—3 of FIG. 1.

STRUCTURE

Figure 2A:
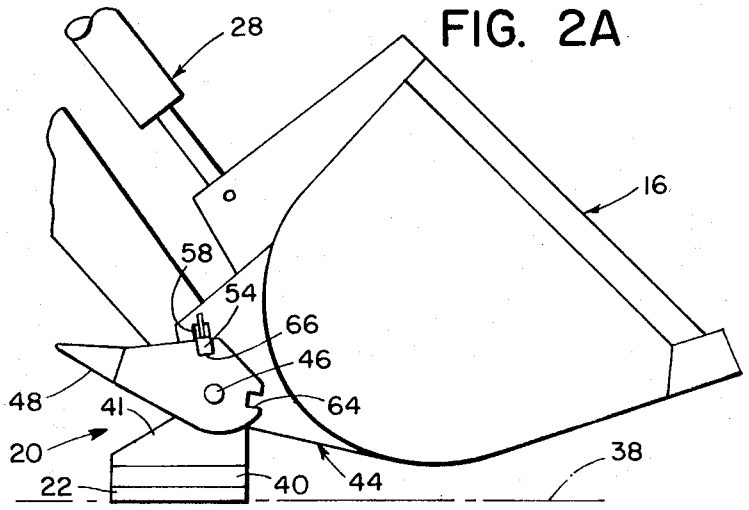
FIG. 2A shows a side view of the stabilizer system in
G. 1.

FIG. 1 shows conventional backhoe/loader tractor
uipment outfitted with a stabilizer system according
the present invention. The loader-bucket/arm unit
nsists of two loader bucket arms 28 and loader bucket
The unit is attached to the front end 30 of tractor 10.
int P is the mid-point of the bottom of the front end
tractor 10. Backhoe arm 36 is attached to the back
d 32 of the tractor to support digging bucket 34 there-
m. Two outriggers 19 extend from the side of the
ctor near rear wheels 14 to provide lateral support.
vo front wheels 12 are disposed on axle 11 located
vard the front of the cab; the axle is generally parallel
front end 30.

Two stabilizers 20 are attached to loader bucket 16.
ch stabilizer has a soft, durable friction surface or pad
made, for example, from rubber or some other substance which is relatively softer than asphalt road surfaces. When disposed as indicated in FIG. 1, the pads contact underlying substrate 38 at areas lying ahead of axle 11 and ahead of and below the bottom of front end 30. The ground contact areas of the pads are on opposite sides of mid-point P of the bottom of front end 30.

FIGS. 2A–2C and FIGS. 3 and 3A show stablizer 20 in greater detail. Stabilizer pad 22 is attached to a metal backing plate 40, which in turn is mounted to bracket assembly 44 by two mounting plates 41 and 42 situated parallel to each other and perpendicular to plate 40. Mounting plates 41 and 42 are attached to pin 46 between side pieces 43 and 45 of bracket assembly 44, and pin 46 extends along axis A and is rotatably attached to bracket sides 43 and 45. Pin 46 also extends through bracket side 45 and the shaft of spike 48 to pivotally attach spike 48 to the outside of bracket assembly 44.

Figure 3A:
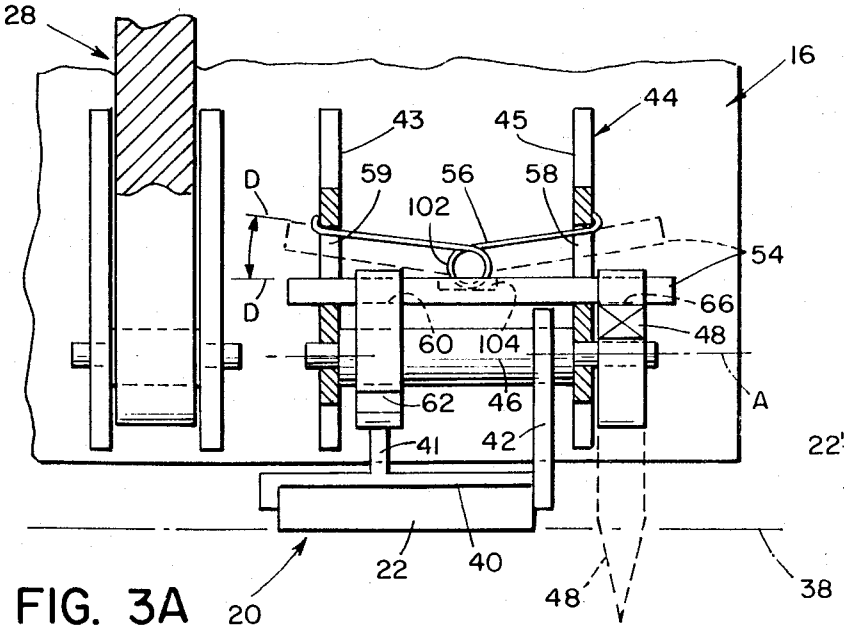
FIG. 3A is taken along 3A—3A of FIG. 3 and shows
atlernative spike orientation in dotted line.

The latching mechanism is best seen in FIGS. 3 and 3A. Latch bar 54 extends through slots 58 and 59 in bracket sides 43 and 45 and has some flexibility to move along D—D, as shown in dotted line in FIG. 3A. Movement of the bar is subject to the bias force of spring 56 which is supported under tension between sides 43 and 45 and has a central loop 102 seated in indentation 104 of bar 54. Mounting plate 41 has two notches 60 and 62 arranged and sized to receive latch bar 54; similarly, shaft 52 of spike 48 has two notches 64 and 66 arranged to receive latch bar 54.

OPERATION AND INSTALLATION

Each stabilizer 20 may be oriented with pad 22 in a horizontal attitude, with the pad facing downwardly, by manually pivoting latch bar 54 to one of the dotted line portions shown in FIG. 3A, thereby freeing the bar from plate 41, and then by rotating mounting plates 41 and 42. To lock the pad in that orientation, latch bar 54 is seated into notch 60 of plate 41 where it is held by the bias of spring 56. At the same time, spike 48 is locked in a horizontal position so as not to interfere with the use of pad 22, by rotating the spike shaft to a horizontal position and seating latch bar 54 in notch 66 of spike shaft 52, by a procedure similar to that described above for pad rotation and locking.

With the stabilizers in the above-recited orientation, loader bucket 16 is extended downwardly until pads 22 are about 6–8 inches below the level of front wheels 12. Tractor 10 is then supported by outriggers 19 and pads 22, with backhoe bucket 34 raised. Bucket 34 is manipulated to dig toward tractor 10 (in the direction of arrow C) using hydraulic cylinders 24 and 26. As bucket 34 begins to exert digging force, it lifts tractor 10 off of outriggers 19 as shown in FIG. 1. Because the stabilizer pad (or spike) contacts the ground forward of the front axle of the tractor, the weight of tractor 10 in this configuration is pivoted forward onto pads 22, and, under that weight, there is sufficient friction between the pads and the substrate to oppose forces generated by digging action of bucket 34 and thus prevent movement of the tractor in response to that action.

Because the stabilizer is used with the loader bucket in a normal upright configuration, the stress imposed on the loader bucket arm, linkage and pins is significantly reduced over that caused by use of the configuration shown in FIG. 7.

Figure 2B:
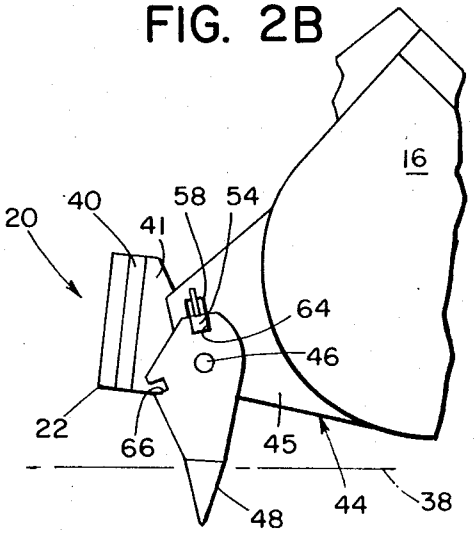
FIG. 2B shows the stabilizer of FIG. 2A partially
oken away with the spike down.

The operating configuration of FIG. 2A is intended for substrate surfaces where it is not feasible to use hard penetrating objects, either because the substrate is too hard for (e.g. concrete) or too easily damaged (e.g. asphalt) by such objects.

Where difficulty in penetrating the substrate or damage to the substrate are not a concern, for example for off-highway use of soft materials or on frozen ground, it may be preferable to use the configuration of FIG. 2B, with frost spike 48 in the operable position. Specifically, the latch bar is pivoted in a manner similar to that described above, to allow spike 48 to be rotated about pin 46 to a vertical position, and pad 22 to be rotated at least 90° out of the operable position to a storage position. The spike and pad are locked in their respective positions when latch bar 54 is seated in notch 64 of shaft 52 and in notch 62 of plate 41.

With the stabilizer fixed in the configuration of FIG. 2B, the equipment is operated as described above for the configuration of FIG. 2A. Extending loader bucket 16 downwardly puts the weight of tractor 10 on the spikes and drives them into the substrate. When both the pad and spike are in their operating positions, the spike extends below pad 22 so that, if the substrate is too soft to resist the downward force on the spike, pad 22 may be rotated to its downward attitude (as in FIG. 2A) to provide a stop against insertion of the spike into the substrate. Ordinarily, however, the tapered configuration of spike 48 should prevent excessive penetration of the substrate.

Figure 2C:
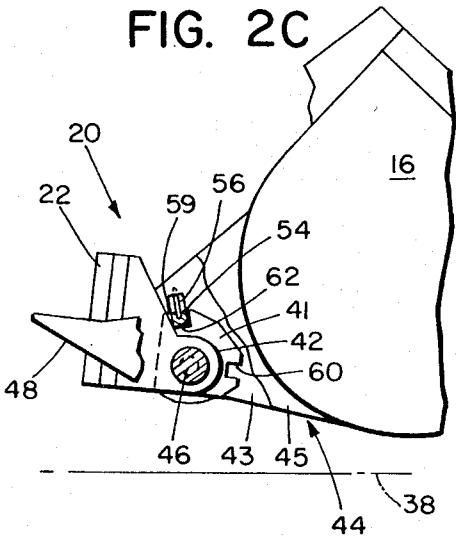
FIG. 2C shows the stabilizer of FIG. 2A partially
oken away with both the pad and spike in a retracted
sition.

When loader bucket 16 is to be used, or when tractor 10 is being transported, the spike and pad may both be rotated out of the way to avoid interfering with such use or transportation of the tractor as shown in FIG. 2C; in that configuration, locking is accomplished when latch bar 54 is seated in notches 62 and 66 of the pad mounting plate and the spike shaft, respectively.

A conventional tractor may be readily (within a few hours) retrofitted with the stabilizer by welding the bracket to the loader bucket.

OTHER EMBODIMENTS

Figure 4C:
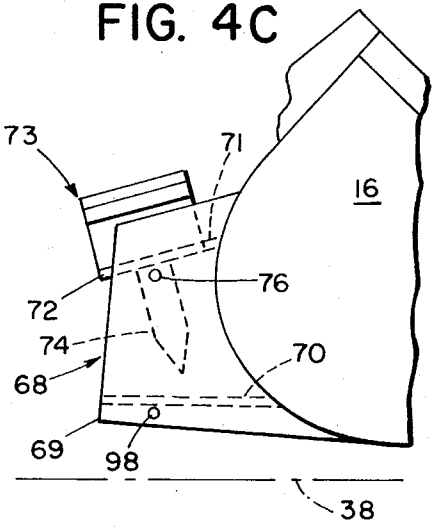
FIG. 4C is a view partially broken away of the em-
diment of FIG. 4A with the pad and spike in a storage
sition.
Figure 4B:
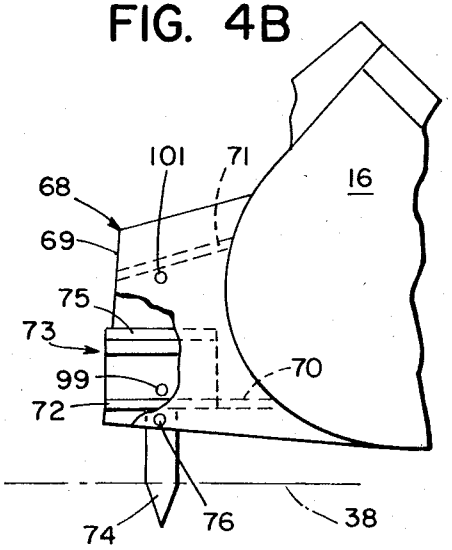
FIG. 4B is a view partially broken away of the em-
diment of FIG. 4A with the spike down.
Figure 4A:
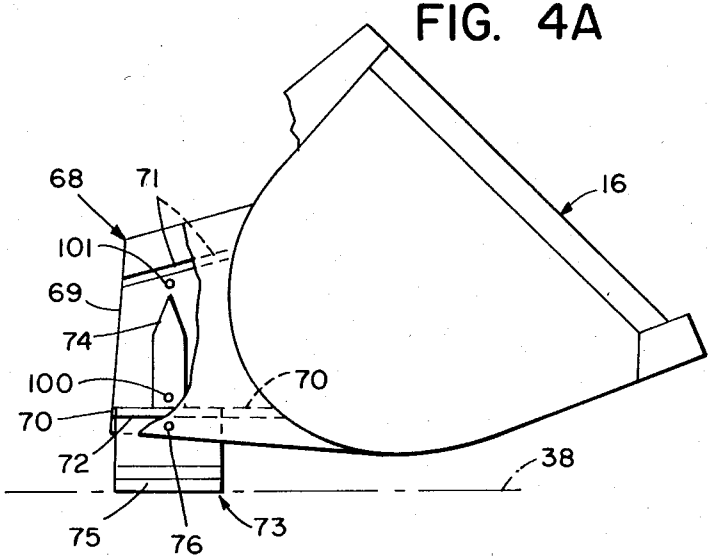
FIG. 4A is a view of an alternate embodiment of the
bilizer with the stabilizer pad down.

FIGS. 4A–4C show an alternate embodiment of the invention in which stabilizer mounting bracket 68 has two parallel plates (one is shown as 69), each defining opposing storage slots 71 and operating slots 70 to accommodate an edge of one of two mounting plates 72 on stabilizer unit 73. A plate 72 may be installed in slot 71 so that unit 73 does not interfere with the operation of loader bucket 74 (FIG. 4C). To use the stabilizer, it is removed from slot 71 and inserted in operating slot 70 with either spike 74 down (FIG. 4B) or with pad 75 down (FIG. 4A). A removable locking pin 76 may be inserted through either hole 101 or 98 in bracket 68, through one of two corresponding holes 99 or 100 in unit 73, and through the other wall (not shown) of bracket 68 to lock the unit in the desired position.

Figure 5B:
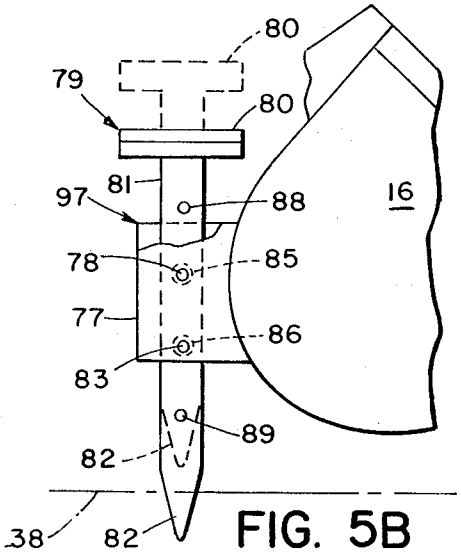
FIG. 5B is the embodiment of FIG. 5A with the spike
tended and showing, in dotted lines, the spike stored.
Figure 5A:
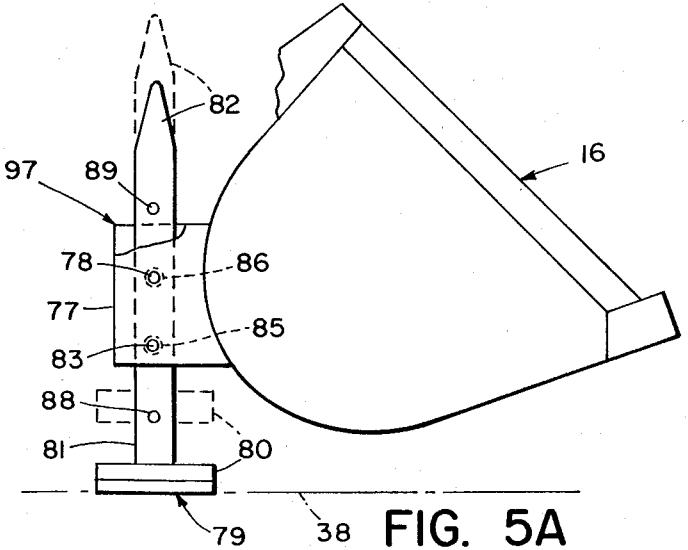
FIG. 5A is a view of a second alternate embodiment
the stabilizer with the stabilizer pad down and show-
g, in dotted lines, the same embodiment with the pad
red.

FIGS. 5A and B show a third embodiment of the invention in which a mounting bracket 97 has two parallel side pieces (one shown as 77) each with two corresponding holes (one shown as 78). Stabilizer unit 79 consists of a shaft 81 with pad 80 and spike 82 disposed at opposite ends thereof in opposite directions. Shaft 81 has four holes 85, 86, 88 and 89 which receive two pins 83 (one shown) to lock the stabilizer through holes 78 in the side pieces of bracket 97 with either the pad down (FIG. 5A) or the spike down (FIG. 5B). For storing the unit, the unit may be moved upward (dotted lines in FIGS. 5A and 5B) and pins 83 replaced through holes 78 and the corresponding holes in the unit shaft.

Figure 6:
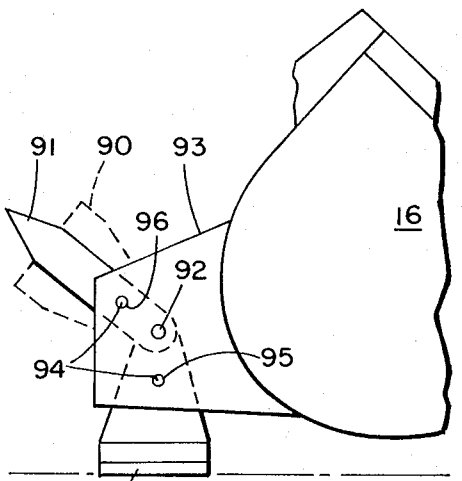
FIG. 6 shows a view, partially broken away of a third
ernate embodiment of the stabilizer with the pad
wn (solid line) and indicates an alternate pad position
th dotted lines.

FIG. 6 shows a fourth embodiment in which both pad 90 and spike 91 pivot about pin 92 in a manner similar to that of the preferred embodiment. In place of the spring-biased latch mechanism of the preferred embodiment, locking pins 94 are inserted through holes 95 or 96 in bracket 93 and corresponding holes in the pad and spike shaft to lock the spike and pad in the desired positions.

Figure 7A:
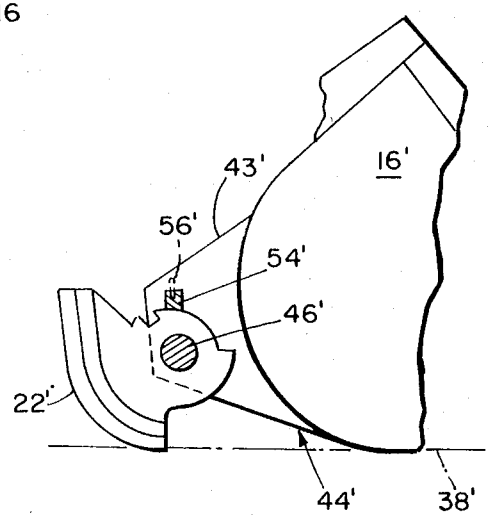
FIGS. 7A and 7B show an alternate embodiment,
rtially broken away, featuring a curved friction sur-
e.
Figure 7B:
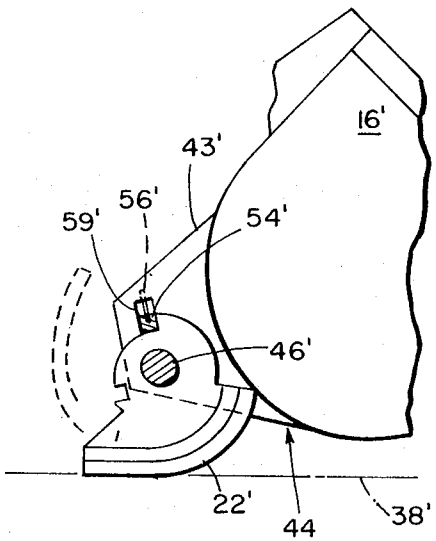

In the above-discussed embodiments, the pad is locked in its downward, horizontal attitude during operation of the stabilizer. In an alternate embodiment of the pad depicted in FIGS. 7A and 7B, the pad 22' is curved in a radius to form a generally cylindrical arc, and, in operation, the pad is free to rotate to and from a forward stop at the horizontal position. As the digging bucket is manipulated toward the tractor, causing the tractor to tend to roll toward the bucket, the pad contacts the ground FIG. 7A and is rotated around the radius to the stop FIG. 7B. The stop prevents forward rotation of the surface past a downwardly disposed attitude. A force tending to move the tractor backward rotates the curved pad away from the stop and toward the storage position. While FIGS. 7A and 7B show a full curve, only the forward and/or the rear edge of the pad need be so curved. The pad may be stored (dotted line in FIG. 7B) in a manner similar to that described for the embodiment of FIGS. 2 and 3.

Other embodiments are within the following claims. For example stabilizers may be attached to the loading bucket arms.

What is claimed is:

1. A stabilization system adapted for use with tractor equipment having a digging bucket disposed from one end and a loader/bucket disposed from a second end opposite said first end, said system comprising:

a stabilization spike;

a friction surface;

a bracket adapted to be fixedly attached to said loader bucket; and, means attached to said bracket for (i) disposing and maintaining said friction surface in either of a first friction surface attitude in which said surface is disposed in a horizontal, downward attitude below said loader bucket and a second friction surface attitude in which said surface is disposed above the bottom of said loader bucket with said surface oriented at an angle of at least 90° relative to that at which it is oriented in said first friction surface attitude, (ii) disposing and maintaining said spike in either of a first spike attitude in which said spike extends generally vertically downwardly below the bottom of said bucket and a second spike attitude in which said spike is disposed above the bottom of said bucket with said spike oriented at an angle of at least 90° relative to that at which it is oriented in said first spike attitude, and (iii) permitting each of said surface and said spike independently to rotate about a horizontal axis between said first attitude and said second attidude thereof, whereby each of said friction surface and said spike when disposed in said first attitude thereof supports and prevents movement of said equipment in respect to digging action of said digging bucket, and in said second attitude thereof permits said loader bucket to be used without interference therefrom.

2. The system of claim 1 further characterized in that said friction surface is a durable material that is relatively softer than asphalt road surfaces.

3. The system of claim 1 further characterized in that said friction surface is curved at its forward and read edges to form a generally cylindrical arc, said surface being rotatably attached to said bracket allowing said surface to rotate about the axis of said, cylindrical arc said axis being generally horizontal and perpendicular to a line extending from the first end to the second end of said equipment, and said bracket comprising a stop to prevent forward rotation of said surface past a downwardly disposed attitude.

4. The system of claim 1 further characterized in that said means attached to said bracket comprises latching means to lock a selected one or both of said spike and said surface in the respective first attitude thereof.

5. A stabilization system adapted for use with tractor equipment having a digging bucket disposed from one end and a loader bucket disposed from a second end opposite said first end, said system comprising:

a stabilization spike;

a friction surface;

a bracket adapted to be fixedly attached to said loader bucket; and, means attached to said bracket for (i) disposing and maintaining said friction surface in either of a first friction surface attitude in which said surface is disposed in a horizontal, downward attitude below said loader bucket and a second friction surface attitude in which said surface is disposed above the bottom of said loader bucket with said surface oriented at an angle of at least 90° relative to that at which it is oriented in said first friction surface attitude, and, (ii) disposing and maintaining said spike in either of a first spike attitude in which said spike extends generally vertically downwardly below the bottom of said bucket and a second spike attitude in which said spike is disposed above the bottom of said bucket with said spike oriented at an angle of at least 90° relative to that at which it is oriented in said first spike attitude, whereby each of said friction surface and said spike when disposed in said first attitude thereof supports and prevents movement of said equipment in respect to digging action of said digging bucket, and in said second attitude thereof permits said loader bucket to be used without interference therefrom, said friction surface and said spike being attached to said bracket so as to permit independent rotation of said surface and said spike about an axis, said axis being horizontal and generally parallel to said second tractor end when said system is attached to said loader.

6. The system of claim 5 further characterized in that said bracket comprises a first plate and said means for attaching said friction surface and said spike to said bracket comprises a second plate connected to said surface and parallel to said first plate and a hinge pin perpendicular to and rotatably attached to said first plate, said second plate being attached to said hinge pin and said spike being rotatably attached to said hinge pin, and further comprising latching means to lock said friction surface and said spike in said first attitudes thereof, said latching means comprising a locking member engaging said first plate, a first recess in said second plate adapted to receive said member when said surface is in said first surface attitude and a first recess in said spike adapted to receive said member when said spike is in said first spike attitude.

7. A stabilization system adapted for use with tractor equipment having a digging bucket disposed from a first end and a loader-bucket/arm unit disposed from a second end opposite said first end, said stabilization system comprising:

a friction surface and a stabilization spike connected in a unit and disposed in opposite directions;

a bracket adapted for attaching said friction surface/spike unit to said loader-bucket/arm unit, said friction surface/spike unit including a mounting plate and said bracket comprises two parallel plates, each bracket plate having a slot to receive opposite edges of said unit mounting plate, whereby said bucket is arranged to dispose either said surface in a horizontal, downward attitude below the level of said unit or said spike in a downward vertical attitude extending below the level of said unit, and either said spike or said friction surface when so extended and disposed, supports and prevents movement of said equipment in response to digging action of said bucket.

8. The equipment of claim 1 further comprising at least two stabilizer systems connected to said loader bucket, one such system having a ground contact area in front of, below and on one side of the mid-point of said second end, and the other having a ground contact area in front of, below and on the side of said mid-point.

9. Digging equipment comprising a tractor cab, a digging bucket disposed from one end of said tractor cab, a loader bucket disposed from the other end of said tractor cab, and a stabilization system, said cab comprising a set of wheels on an axle located toward the front end of said tractor cab, said axle being generally parallel to said front end, and said stabilization system being attached to said loader bucket by a bracket and comprising a friction surface attached to said bracket by means for disposing said surface in a horizontal, downward attitude and for extending said surface below the level of said equipment, and a stabilization spike attached to said bracket by means for disposing said spike in a vertical downward attitude and for extending said spike below the level of said equipment, said friction surface and said spike being attached to said bracket by means adapted to permit said surface and said spike, independently, to rotate about a horizontal axis generally parallel to said tractor one end, whereby each of said spike and said friction surface, when so extended and disposed, is arranged to contact a ground-support area lying ahead of said axle and support and prevent movement of said equipment in response to digging action of said digging bucket, and, both said spike and said friction surface may be rotated about said axis away from said respective downwardly disposed attitudes at least 90° and said loader bucket may be used without interference from said stabilizer system.

10. The system of claim 6 wherein said locking member comprises a spring-biased locking member, said recesses are notches, and opposite end portions of said locking member are adapted to snap into respective ones of said notches.

11. The system of claim 6 wherein said locking member is a pin, and said recesses are holes in said second plate and said spike, and said locking member is adapted to extend through said holes in said second plate and said spoke and a corresponding hole in said first plate.

12. The system of claim 6 wherein each of said second plate and said spike include a respective second recess, said spike second recess being adapted to receive said member when spike is in said second spike attitude and said second plate recess being adapted to receive said member when said plate is in said second plate attitude.

* * * * *

UNITED STATES PATENT AND TRADEMARK OFFICE

CERTIFICATE OF CORRECTION

PATENT NO. : 4,531,883

DATED : July 30, 1985

INVENTOR(S) : Carroll H. Arnold

It is certified that error appears in the above-identified patent and that said Letters Patent are hereby corrected as shown below:

Column 5, line 34, "a loader/bucket" should be --a loader bucket--.

Column 6, line 5, "read" should be --rear--.

Signed and Sealed this

Nineteenth Day of November 1985

[SEAL]

*Attest:*

DONALD J. QUIGG

*Attesting Officer*

*Commissioner of Patents and Trademarks*